US010003906B2

(12) United States Patent
Brandenburg et al.

(10) Patent No.: US 10,003,906 B2
(45) Date of Patent: Jun. 19, 2018

(54) DETERMINING AND USING ROOM-OPTIMIZED TRANSFER FUNCTIONS

(71) Applicants: Fraunhofer-Gesellschaft zur Foerderung der angewandten Forschung e.V., Munich (DE); Technische Universitaet Ilmenau, Ilmenau (DE)

(72) Inventors: Karlheinz Brandenburg, Ilmenau (DE); Stephan Werner, Ilmenau (DE); Christoph Sladeczek, Ilmenau (DE)

(73) Assignees: FRAUNHOFER-GESELLSCHAFT ZUR FOERDERUNG DER ANGEWANDTEN FORSCHUNG E.V., Munich (DE); TECHNISCHE UNIVERSITAET ILMENAU, Ilmenau (DE)

( * ) Notice: Subject to any disclaimer, the term of this patent is extended or adjusted under 35 U.S.C. 154(b) by 0 days. days.

(21) Appl. No.: 15/362,017

(22) Filed: Nov. 28, 2016

(65) Prior Publication Data

US 2017/0078820 A1 Mar. 16, 2017

Related U.S. Application Data

(63) Continuation of application No. PCT/EP2015/060792, filed on May 15, 2015.

(30) Foreign Application Priority Data

May 28, 2014 (DE) ..... 10 2014 210 215

(51) Int. Cl.
*H04S 7/00* (2006.01)

(52) U.S. Cl.
CPC ..... *H04S 7/306* (2013.01); *H04S 7/301* (2013.01); *H04S 7/304* (2013.01); *H04S 2400/11* (2013.01); *H04S 2420/01* (2013.01)

(58) Field of Classification Search
CPC ..... H04S 7/304; H04S 7/306; H04S 7/301; H04S 2420/01; H04S 2400/11
(Continued)

(56) References Cited

U.S. PATENT DOCUMENTS

2004/0136541 A1* 7/2004 Hamacher ..... H04R 25/70 381/60
2006/0045294 A1 3/2006 Smyth
(Continued)

FOREIGN PATENT DOCUMENTS

JP 2014-505420 2/2014
WO 2013/058728 4/2013

OTHER PUBLICATIONS

International Search Report for PCT/EP2015/060792.
(Continued)

*Primary Examiner* — Melur Ramakrishnaiah
(74) *Attorney, Agent, or Firm* — McClure, Qualey & Rodack, LLP

(57) ABSTRACT

A device for determining room-optimized transfer functions for a listening room serving for room-optimized post-processing of audio signals in spatial production, is configured to analyze room acoustics of the listening room and to determine, based on the analysis of the room acoustics, the room-optimized transfer functions for the listening room where the spatial reproduction by means of a binaural close-range sound transducer is to take place. The spatial reproduction of the audio signals by means of the binaural close-range sound transducer may then be emulated using known head-related transfer functions und using the room-optimized transfer functions, wherein a room to be synthesized may be emulated based on the head-related transfer functions, and wherein the listening room may be emulated based on the room-optimized transfer functions.

22 Claims, 5 Drawing Sheets

(58) Field of Classification Search
USPC ..... 381/309, 310, 303, 58, 66, 314, 59, 17, 381/300, 99
See application file for complete search history.

(56) References Cited

U.S. PATENT DOCUMENTS

2008/0273708 A1* 11/2008 Sandgren ..... G10K 15/08 381/63
2013/0272527 A1* 10/2013 Oomen ..... G10K 15/12 381/17
2014/0337016 A1* 11/2014 Herbig ..... G06T 7/73 704/201

OTHER PUBLICATIONS

International Preliminary Examination Report for PCT/EP2015/060792 (and its English translation).
Rychtarikova et al. "Binaural sound source localization in real and virtual rooms" J. Audio Eng. Soc., vol. 57, No. 4, Apr. 2009.
Paul Sauk and Duane Satorius, "Creating a multi-dimensional communication space to improve the effectiveness of 3-D Audio" IEEE 2007.
Rychtarikova et al. "Perceptual validation of virtual room acoustics: sound localization and speech understanding" Applied Acoustics 72 (2011) 196-204.
Pavel Zahorik, "Preceptually relevant parameters for virtual listening simulation of small room acoustics" J. Acoust. Soc. Am. 126 (2), Aug. 2009.
Office Action issued in corresponding German patent application dated Nov. 27, 2014.
Office Action issued in corresponding Korean patent application No. 10-2016-7036695 dated Oct. 30, 2017 (and its English translation).

* cited by examiner

DETERMINING AND USING ROOM-OPTIMIZED TRANSFER FUNCTIONS

CROSS-REFERENCE TO RELATED APPLICATIONS

This application is a continuation of copending International Application No. PCT/EP2015/060792, filed May 15, 2015, which is incorporated herein by reference in its entirety, and additionally claims priority from German Application No. 10 2014 210 215.4, flied May 28, 2014, which is also incorporated herein by reference in its entirety.

BACKGROUND OF THE INVENTION

Embodiments of the present invention relate to a device for determining "room-optimized transfer functions" for a listening room, to a corresponding method and to a device for spatially reproducing an audio signal using corresponding methods. In accordance with preferred embodiments, reproduction takes place by means of a binaural close-range sound transducer, such as, for example, by means of a stereo headset or stereo in-ear earphones. Further embodiments relate to a system comprising the two devices, and to a computer method for performing the methods mentioned.

The perceptive quality when presenting a spatial auditory scene, for example on the basis of a multi-channel audio signal, is decisively dependent on the acoustic artistic design of the contents of the presentation, on the reproduction system and on the room acoustics of the listening room or room. A main goal when developing audio reproduction systems is producing auditory events which are estimated by the listener as being plausible. This plays an important role when reproducing image-sound contents, for example. With contents perceived by the user as being plausible, various perceptual quality features, such as, for example, localizability, perception of distance, perception of spatiality and sound aspects of the reproduction, have to meet the expectations. In the ideal case, the perception of the situation reproduced coincides with the real situation in the room.

In loudspeaker-based audio reproduction systems, two-channel or multi-channel audio material is reproduced in a listening room. This audio material may originate from a channel-based mixture where the finished loudspeaker signals are already present. In addition, the loudspeaker signals may also be generated by an object-based sound reproduction method. The loudspeaker reproduction signals are generated based on a description of a tonal object (for example position, volume etc.) and knowing the prevailing loudspeaker setup. Thus, phantom sound sources which usually are located on the connection axes between the loudspeakers are generated. Depending on the loudspeaker setup chosen and the prevailing room acoustics of the listening room, these phantom sound sources may be perceived by the listener in different directions and distances. The room acoustics here has a decisive influence on the harmony of the auditory scene reproduced.

Reproduction via loudspeaker signals, however, is not practical in every listening situation. In addition, it is not possible to install loudspeakers anywhere. Examples of such situations may be listening to music on mobile terminals, usage in changing rooms, user acceptance or acoustic molestation of others. Close-range sound transducers, like in-ears or headsets, which are "worn" directly at or in direct proximity to the ear, are frequently used as an alternative for loudspeakers.

Classical stereo reproduction using sound transducers which are, for example, equipped with an acoustic driver for each side or ear each, produce a perception in the listener of the reproducing phantom sound sources to be located in the head on the connection axis between the two ears. This is referred to as the so-called "in-head localization". An external perception of plausible effect (externicity) of the phantom sound sources, however, does not take place. The phantom sound sources produced in this way usually neither comprise a direction (information) decodable for a user nor distance (information) which would, for example, be present when reproducing the same acoustic scene via a loudspeaker system (for example 2.0 or 5.1) in the listening room.

In order to bypass in-head localization when reproducing using headsets, methods of binaural synthesis are used (without losing any of the artistic design and mixture in the audio material). In binaural synthesis, so-called "outer ear transfer functions" (or head-related transfer function, HRTF) are used for the left and right ears. These head-related transfer functions comprise, for each ear, a plurality of respective directional vectors for head-related transfer functions associated to virtual sound sources, in accordance with which the audio signals are filtered when reproducing same, so that an auditory scene is represented spatially or spatiality is emulated. Binaural synthesis makes use of the fact that interaural features are decisively responsive for the development of perceiving the direction of a sound source, wherein these interaural features are represented in the head-related transfer functions. When an audio signal is to be perceived from a defined direction, this signal is filtered using the HRTFs of the left or right ear, belonging to this direction. Using binaural synthesis, it is thus possible to reproduce both a realistic surround sound scene, for example stored as multi-channel audio, via the headset. In order to virtually simulate a loudspeaker setup, the HRTF pairs, bound to a direction, are used for each loudspeaker to be simulated. For a plausible representation of direction and distance of the loudspeaker setup, additionally the direction-dependent acoustic transfer functions of the listening room (room-related transfer functions, RRTFs) also have to be emulated. These are then combined with the HRTFs and result in binaural room impulse responses (BRIRs). The BRIRs may be applied to the acoustic signal as filters.

However, late research and examinations dearly reveal that the plausibility of an audio reproduction, apart from the physically correct synthesis of the reproduction signals, is also determined decisively by context-dependent quality parameters and, in particular, on the horizon of expectations of the user as regards room acoustics. Therefore, there is need for an improved approach in binaural synthesis.

It is the object of the present invention to provide improved spatial reproduction by means of close-range sound transducers, in particular for making acoustics synthesizing and the horizon of expectations of the consumer coincide.

SUMMARY

An embodiment may have a device for determining room-optimized transfer functions for a listening room derived for the listening room and serving for room-optimized post-processing of audio signals in spatial reproduction, wherein the spatial reproduction of the audio signals is emulated by means of a binaural close-range sound transducer using known head-related transfer functions and using the room-optimized transfer functions, wherein a room to be synthesized may be emulated based on the head-related transfer functions, and wherein the listening room may be emulated based on the room-optimized transfer functions, wherein the device is configured to analyze room acoustics of the listening room and to determine, starting from analyzing the room acoustics, the room-optimized transfer functions for the listening room where the spatial reproduction by means of the binaural close-range sound transducer is to take place, wherein the device has a storage in which may be deposited a plurality of room-optimized transfer function families for a plurality of listening rooms.

According to another embodiment, a method for determining room-optimized transfer functions for a listening room which are derived for the listening room and may serve for room-optimized post-processing of audio signals in spatial reproduction, wherein the spatial reproduction of the audio signals by means of a binaural close-range sound transducer is emulated using known head-related transfer functions and using the room-optimized transfer functions, wherein a room to be synthesized may be emulated based on the head-related transfer functions, and wherein the listening room may be emulated based on the room-optimized transfer functions, may have the steps of: analyzing prevailing room acoustics of the listening room; and determining the room-optimized transfer functions for the listening room where spatial reproduction by means of the binaural close-range sound transducer is to take place, on the basis of analyzing the room acoustics; depositing a plurality of room-optimized transfer function families for a plurality of listening rooms.

Another embodiment may have a device for spatial reproduction of an audio signal by means of a binaural close-range sound transducer, wherein the spatial reproduction is emulated using known head-related transfer functions and using room-optimized transfer functions for a listening room, wherein a room to be synthesized may be emulated based on the head-related transfer functions, and wherein the listening room may be emulated based on the room-optimized transfer functions, wherein the room-optimized transfer functions have been determined beforehand for the respective listening room; wherein the device has a first storage in which are stored a first plurality of transfer function families for different listening rooms, and a position-determining unit, wherein the position-determining unit is configured to identify the position and determine the listening room using the position identified; and wherein the device is configured to select, for emulating the spatial reproduction, the corresponding transfer functions for the respective listening room from the transfer function families.

According to still another embodiment, a method for spatially reproducing an audio signal by means of a binaural close-range sound transducer may have the steps of: post-processing the audio signal using known head-related transfer functions and using room-optimized transfer functions for a listening room which have been determined beforehand for the listening room where reproduction by means of the binaural close-range sound transducer is to take place, wherein a room to be synthesized may be emulated based on the head-related transfer functions, and wherein the listening room may be emulated based on the room-optimized transfer functions; storing a first plurality of transfer function families for different listening rooms in a first storage; identifying a position; and determining the listening room using the position, wherein the device is configured to select, for emulating the spatial reproduction, the corresponding transfer functions for the respective listening room from the transfer function families.

Another embodiment may have a system having: a device for determining room-optimized transfer functions for a listening room as mentioned above; and a device for spatial reproduction of an audio signal by means of a binaural close-range sound transducer as mentioned above.

Still another embodiment may have a computer program having program code for performing a method for determining room-optimized transfer functions for a listening room which are derived for the listening room and may serve for room-optimized post-processing of audio signals in spatial reproduction, wherein the spatial reproduction of the audio signals by means of a binaural close-range sound transducer is emulated using known head-related transfer functions and using the room-optimized transfer functions, wherein a room to be synthesized may be emulated based on the head-related transfer functions, and wherein the listening room may be emulated based on the room-optimized transfer functions, having the steps of: analyzing prevailing room acoustics of the listening room; and determining the room-optimized transfer functions for the listening room where spatial reproduction by means of the binaural close-range sound transducer is to take place, on the basis of analyzing the room acoustics; depositing a plurality of room-optimized transfer function families for a plurality of listening rooms, when the program runs on a computer, CPU or mobile terminal.

Another embodiment may have a computer program having program code for performing a method for spatially reproducing an audio signal by means of a binaural close-range sound transducer, having the steps of: post-processing the audio signal using known head-related transfer functions and using room-optimized transfer functions for a listening room which have been determined beforehand for the listening room where reproduction by means of the binaural close-range sound transducer is to take place, wherein a room to be synthesized may be emulated based on the head-related transfer functions, and wherein the listening room may be emulated based on the room-optimized transfer functions; storing a first plurality of transfer function families for different listening rooms in a first storage; identifying a position; and determining the listening room using the position, wherein the device is configured to select, for emulating the spatial reproduction, the corresponding transfer functions for the respective listening room from the transfer function families, when the program runs on a computer, CPU or mobile terminal.

Embodiments of the present invention provide a (portable) device for determining "room-optimized transfer functions" for a listening room on the basis of analyzing the room acoustics. The room-optimized transfer functions serve for room-optimized post-processing of audio signals in spatial reproduction, wherein a room to be synthesized may be emulated based on the head-related transfer functions (HRTFs), and wherein the listening room may be emulated based on the room-optimized transfer functions. By using these two transfer functions which, when combined, may also be referred to as binaural room-related room impulse response, the result is a realistic surround sound simulation which, as regards spatiality, corresponds to the features predetermined by the multi-channel (stereo) signal, but improved by considering the horizon of expectations which is anticipated in particular by room acoustics.

In correspondence with further embodiments, the present inventions provides another (portable) device for spatially reproducing an audio signal by means of a binaural close-range sound transducer wherein the spatial reproduction is emulated using known head-related transfer functions and using transfer functions optimized for a listening room, so that, when reproducing audio contents, the listening room characteristic is impressed on the acoustic signals emitted by means of the close-range sound transducer.

In correspondence with the central idea, the present invention thus provides prerequisites for considering cognitive effects when reproducing multi-channel stereo. In correspondence with a first aspect, room-optimized transfer functions for the respective listening room are determined where, for example, an auditory scene is to be reproduced by means of a headset (generally by means of a binaural close-range sound transducer). Determining the room-optimized transfer function principally corresponds to deriving a room-acoustic filter on the basis of the room acoustics determined or measured, with the goal of synthetically representing the acoustic features of the real room. In a second step, the auditory scene may than be reproduced in correspondence with a second inventive aspect, both using the HRTFs and using the room-optimized transfer functions as a surround sound simulation. When reproducing, spatiality is generated by means of the HRTFs, wherein adjusting spatiality to the current listening room situation is achieved by means of room-optimized transfer functions. In other words, this means that the room-optimized transfer functions adjust or post-process the HRTFs or signals processed by the HRTFs. The result is that, when reproducing audio contents, the divergence between the room to be reproduced, defined by the multi-channel audio material, and the listening room where the listener is located, is reduced.

There are different ways for determining the room-optimized transfer functions, i.e., corresponding to a first variation, determining by measuring technology using a test sound source and a microphone such that the room acoustics may be analyzed over a test distance in the listening room in order to obtain an acoustic model of the room. Corresponding to a second variation, natural noise, such as, for example, voice, may also be used as test signals. The second variation offers the special advantage that practically any electrical terminal device comprising a microphone, such as, for example, a mobile phone or smartphone where the functionality described above is implemented, is sufficient for determining the room acoustics. In correspondence with a third variation, the analysis of the listening room or determining the acoustic room model may take place on the basis of geometrical models. In this context, it would also be conceivable for a geometrical model to be detected optically, for example using a camera which is typically also integrated in mobile terminals (like mobile phones) in order to calculate the acoustic model of the listening room afterwards. Departing from an acoustic room model determined in this way, the room-optimized transfer functions may then be identified.

In correspondence with further embodiments, not only the listening room may be taken into consideration, but also positioning of the listener in the listening room. The background here is that the room acoustics or acoustic perception will change depending on whether the listening position is closer to the wall or which direction the listener is directed to. Thus, in correspondence with further embodiments, a plurality of direction-dependent and/or position-dependent transfer functions (transfer function families) may be deposited within the room-optimized transfer functions which, for example, are selected here in dependence on the position of the listener in the listening room or on the angle of view of the listener.

As regards the room-optimized transfer functions, it is also of advantage for a plurality of room-optimized transfer function families for different listening rooms to be deposited in the device for spatial reproduction or in the database coupled to the device, so that these may be fetched depending on which room the listener is located in at present. The device for spatial reproduction may exemplarily also comprise a position-determining device, like GPS.

In correspondence with further embodiments, it is also possible to impress on the audio material to be reproduced the corresponding characteristic of a virtual loudspeaker setup which exemplarily corresponds to the real loudspeaker setup in the listening room or is freely configured, apart from or in parallel to the listening room characteristic.

Further embodiments relate to corresponding methods for determining the room-optimized transfer functions and for reproducing multi-channel stereo audio signals (or object-based audio signals or WFS-audio signals) using the room-optimized transfer functions.

BRIEF DESCRIPTION OF THE DRAWINGS

The following embodiments will be discussed in detail referring to the appended drawings, in which.

DETAILED DESCRIPTION OF THE INVENTION

Figure 1A:
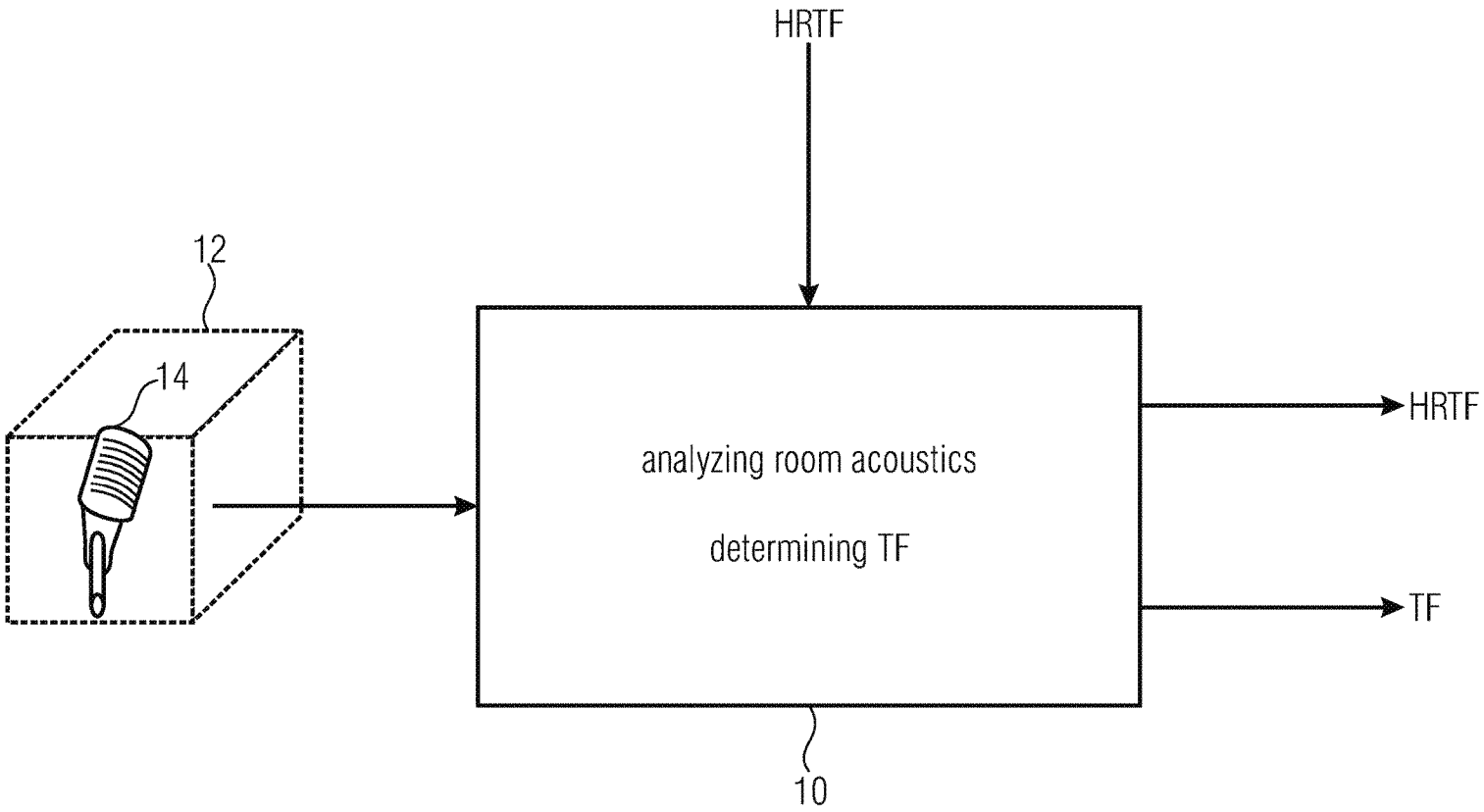
FIG. 1*a* shows a schematic block circuit diagram of a device for determining listening-room optimized transfer functions for a listening room.

Before embodiments of the present invention will be discussed below in greater detail referring to the appended drawings, it is to be pointed out that equal elements or elements of equal effect are provided with equal reference numbers such that a description thereof is mutually applicable or exchangeable.

Before describing the invention, the motivation for detecting and auralizing the room acoustics of a listening room for a location-dependent spatial sound reproduction using headsets will be discussed. In this context, binaural synthesis will be explained briefly and there will be an overview of the head-related transfer functions (HRTFs) used for binaural synthesis and variations contained in the head-related transfer functions, which may be manipulated. Using this overview, it is also shown how the HRTFs are adapted by the room-optimized transfer functions TF to be determined in order to consider the room acoustics conditions in accordance with the invention.

Binaural synthesis is based on the fact that an audio signal, before being output via a sound transducer (preferably directly at one ear), is filtered by a certain filter function or HRTF, wherein the filter characteristic differs depending on the direction vector or virtual sound source, in order to thus emulate surround sound, for example when using a headset. The filter functions/HRTFs are modeled in accordance with natural sound localization mechanisms of human hearing. This allows processing the audio signal in the analog or digital domain or impressing an acoustic characteristic thereon as if same were emitted by any position in the room. The mechanisms when localizing sound are:

Recognizing the lateral direction of incidence;

Recognizing the direction of incidence in the medial plane; and

Recognizing the distance.

Acoustic features, such as run-time differences between left/right and (frequency-dependent) level differences between left/right, are decisive for localizing relative to the lateral direction of incidence. In the case of run-time differences, in particular phase run-time at low frequencies and group run-time at high frequencies may be differentiated between. These run-time differences may be reproduced via signal processing using any stereo driver. Identifying the direction of incidence in the medial plane is based in particular on the fact that the outer ear and/or the entrance of the auditory canal perform direction-selective filtering of the acoustic signal. This filtering is frequency-selected such that an audio signal may at first be filtered by such a frequency filter in order to simulate a certain direction of incidence or emulate spatiality. Determining the distance between a sound source and the listener is based on different mechanisms. The main mechanisms are volume, frequency-selective filtering of the sound path covered, sound reflection and initial time gap. A large part of the factors mentioned above is individual for persons. Variables individual for persons may, for example, be the distance between the ears or the shape of the outer ear which has a particular effect on the lateral and medial localization. Surround sound emulation takes place by manipulating an audio signal as regards the mechanisms mentioned, wherein the manipulation parameters are mapped in the HRTFs (in dependence on room direction and distance).

These HRTFs (head-related transfer functions) are intended primarily for free-filed sound propagation. The background here is the fact that the three factors mentioned above for localization are corrupted when being applied in closed rooms in that the sound emitted by a sound source reaches the listener not only directly, but also in a reflected manner (for example via walls), which results in a change in the acoustic perception. This means that, in rooms, there is direct sound and reflected sound (arriving later), wherein these types of sound may be differentiated by the listener, for example using the run-time for certain frequency groups and/or the position of the secondary sound source in the room. These (Hall) parameters additionally are dependent on the size of the room and quality (for example attenuation, shape) such that a listener is able to estimate the room size and quality. Since these room acoustics parameters are principally perceived via the same mechanism as those of localization, room acoustics may also be emulated in a binaural manner. For emulating room acoustics, the HRTF is extended by means of the RRTF to form the binaural room impulse response (BRIR) which simulates certain acoustic room conditions for the listener in the case of headset reproduction. Thus, depending on the virtual room size, a change in the Hall behavior, shifting secondary sound sources, changing the volume of the secondary sound sources, in particular in relation to the volume of the primary sound sources, take place.

As has been mentioned in the beginning, cognitive effects also play an important role in the listener. Examinations as regards such cognitive effects have resulted in the fact that the relevance of parameters, like the degree of matching between the listening room and the room to be synthesized, a plausible auditory illusion taking place, is high. In the case of low divergence between the listening room and the room to be reproduced, the person skilled in the art talks about low externicity of the auditory event.

Encouraged by this, binaural synthesis is to be extended such that the binaural simulation of an auditory scene may be adapted to the context of usage. In detail, the simulation is adapted to the listening conditions, such as, for example, current room acoustics (attenuation) and geometry of the listening room. Perception of distance, perception of spatiality and perception of direction here may be varied such that they seem plausible in relation to the current listening room. Variation parameters are, for example, the HRTF or RRTF features, like run-time differences, level differences, frequency-selective filtering or initial time gap. Adaptation takes place, for example, in a way that a room size of a certain sound behavior (reverberation behavior or reflection behavior) is emulated or distances between the listener and the sound source, for example, are limited to a maximum value. A further factor of influence on the surround sound behavior is the position of the user in the listening room since it is decisive as regards reverberation and reflection whether the user is positioned in the center of the room or close to a wall. This behavior may also be emulated by adapting the HRTF or RRTF parameters. It will be discussed subsequently how or using which means the HRTF or RRTF parameters are adapted in order to improve plausibility of the acoustic simulation locally.

The concept of auralizing room acoustics, in its basic structure, includes two components represented by two independent devices on the one hand and by two corresponding methods on the other hand. The first component, i.e. detecting room-optimized transfer functions TF, is discussed referring to FIGS. 1*a* and 1*b*, before using the room-optimized transfer functions TF will be discussed referring to FIGS. 2*a* and 2*b*.

FIG. 1*a* shows a device 10 for determining transfer functions TF optimized for a listening room 12. In order to determine the room-optimized transfer functions TF, the listening room 12 or room acoustics thereof is analyzed. Thus, the device 10 includes an interface, exemplarily illustrated here as a microphone interface (cf. reference numeral 14), for detecting room-related data. Since the room-optimized transfer functions TF on the basis of which the listening room characteristic is subsequently to be impressed on an acoustic material by means of binaural synthesis, is typically configured such that HRTFs present already are adapted, the device 10 can determine the transfer functions TF while considering the HRTFs to be employed. This means that the device 10 may optionally include another interface for reading or passing on HRTFs.

Subsequently, different procedures for determining room acoustics will be discussed starting from the device 10, on the basis of which the room-optimized transfer functions TF are then determined in a subsequent step. In correspondence with a first variation, detecting the prevailing room-acoustic conditions of the listening room may be done using measuring technology. Exemplarily, the room acoustics of the listening room 12 is measured, using the device 10, by an acoustic measuring method. A test signal, emitted via an optional loudspeaker (not illustrated), is used for this. Reproducing the test signal or driving the loudspeaker here may take place using the device 10 when the device 10 includes a loudspeaker interface (not illustrated) or is the loudspeaker itself. The measuring signal emitted to the room 12 via the loudspeaker is recorded by means of the microphone 14 so that, departing from the change in signal over the measuring distance (between loudspeaker microphone), room acoustics may be identified such that at least a room-optimized transfer function TF may be derived for a room direction or a plurality of room-optimized transfer functions TF, for example. Room-acoustic parameters relevant for the listening room are then derived from the measured transfer function from one direction. These are then used to generate the room-optimized transfer functions TF for the other directions required. Here, the discrete first reflections may be adapted to other spatial directions and distances of the virtual sound source positions to be mapped, for example by compressing and/or extending regions of the impulse response (transfer function in the time range). The information relevant for perceiving the direction are located in the HRTFs. In order to determine the room-optimized transfer functions TF for all spatial directions or at very high precision, it may be of advantage in accordance with further embodiments to repeat analysis by means of the test signal for different positions of microphone 14 and loudspeakers in the listening room 12.

In accordance with another variation, determining the room acoustics may be estimated using acoustic signals reverberated already by the listening room 12. Examples of such signals are ambient noise present anyway, like a voice signal of a user. The algorithms used here are derived from algorithms for removing reverberation from a voice signal. The background here is that typically, in reverberation canceling algorithms, the room transfer function present on the signal from which reverberation is to be removed is estimated. Up to now, these algorithms have been used to identify a filter which, when applied to the original signal, results best in the signal not affected by reverberation. When being applied in analyzing room acoustics, the filter function is not identified, but only an estimation method is used in order to recognize the features of the listening room. In this procedure, the microphone 14 which is coupled to the device 10 is again used.

In correspondence with a third variation, room acoustics may be simulated based on geometrical room data. This procedure is based on the fact that geometrical data (for example edge dimensions, free path length) of a room 12 allow estimating the room acoustics. The room acoustics of the room 12 may be simulated either directly or identified approximately based on room-acoustical filter databases which include acoustics comparative models. Methods, like acoustic Ray Tracing or mirror sound source methods in connection with a diffuse sound model are to be mentioned in this context, for example. The two methods mentioned are based on geometrical models of the listening room. In this context, the Interface mentioned above for detecting a room-related data of the device 10 need to necessarily be a microphone interface, but may also generally be referred to as data interface serving for reading geometry data. In addition, it is also possible for further data beyond room acoustics to be read by means of the interface, which include information on a loudspeaker setup present in the listening room, for example.

Several ways of acquiring geometrical room data are conceivable: in correspondence with a first sub-variation, the data may be taken from a geometrical database, for example Google Maps Inhouse. These databases typically include geometrical models, for example vector models of room geometries, starting from which the distances, but also reflection characteristics may be determined in the first place. In correspondence with a further sub-variation, an image database may also be used as input, wherein in this case the geometrical parameters are determined in an intermediate step afterwards by means of image recognition. In correspondence with an alternative sub-variation, it would also be possible, instead of taking image information of an image database, to determine the image information by means of a camera or, generally, an optical sensor, such that a geometrical model may be determined directly by the user. Starting from the room geometry determined on the basis of image data, the room acoustics may then be simulated in analogy to the previous point.

The room-optimized transfer functions TF are derived, by means of the room acoustic models simulated in this way, in a subsequent step for at least one room, preferably for a plurality of rooms. Deriving the room-optimized transfer functions TF, which is comparable to the RRTFs as regards the parameters, in principle corresponds to determining a filter function (per room direction), by means of which the acoustic behavior in the room may be simulated, for example when the sound propagates in a certain room direction. The room-specific transfer functions TF include, per room, typically a plurality of transfer functions by means of which the head-related transfer functions (associated to individual solid angles) may be adapted correspondingly (comparable to the procedure when processing the room impulse response). The plurality of room-optimized transfer functions TF thus is typically dependent on the number of head-related transfer functions which occur as a family of functions and include a plurality, i.e. for left/right and for the relevant directions. The precise number of head-related transfer functions in the HRTF model is dependent on the desired room resolution capability and may vary considerably due to the fact that there are also HRTF models where a large number of direction vectors are determined by means of interpolation. It becomes obvious from this context why it is sensible for the HRTF model to be used by the device for determining the room-optimized transfer function TF. In another step, the room-optimized transfer functions TF determined are stored in a room-acoustic filter database, for example.

In accordance with a further embodiment, for each listening room, a plurality of room-optimized transfer function families (TF) may be determined and stored, thereby taken into account that the listening room functions or the acoustic behavior in the listening room differ depending on the position of the listener. In other words, a special room-optimized transfer characteristic may be determined per position (possible) of the user in the listening room 12, wherein determination thereof may be based on one and the same acoustic model of the listening room 12. Consequently, preferably analysis of the listening room is to be performed only once. In correspondence with another embodiment, different room-optimized transfer function families (TF) may be determined per room direction which the user looks in.

The device 10 described above may be implemented to be different. In correspondence with preferred embodiments, the device 10 is implemented as a mobile apparatus, wherein in this case the sensor 14, for example the microphone or camera, may be integrated correspondingly. This means that further embodiments relate to a device for identifying the room-optimized transfer function TF including the analysis unit 10 on the one hand and a microphone and/or camera on the other hand. The analysis unit 10 here may for example be implemented as hardware or to be software-based. Thus, embodiments of the device 10 include an internal CPU or one coupled via cloud computing, or other logics configured to determine room-optimized transfer functions TF and/or listening room analysis. The method or, in particular, the basic steps of the method on which the algorithm for a software-implemented determination of room-optimized transfer functions TF is based will be discussed below referring to FIG. 1*b*.

Figure 1B:
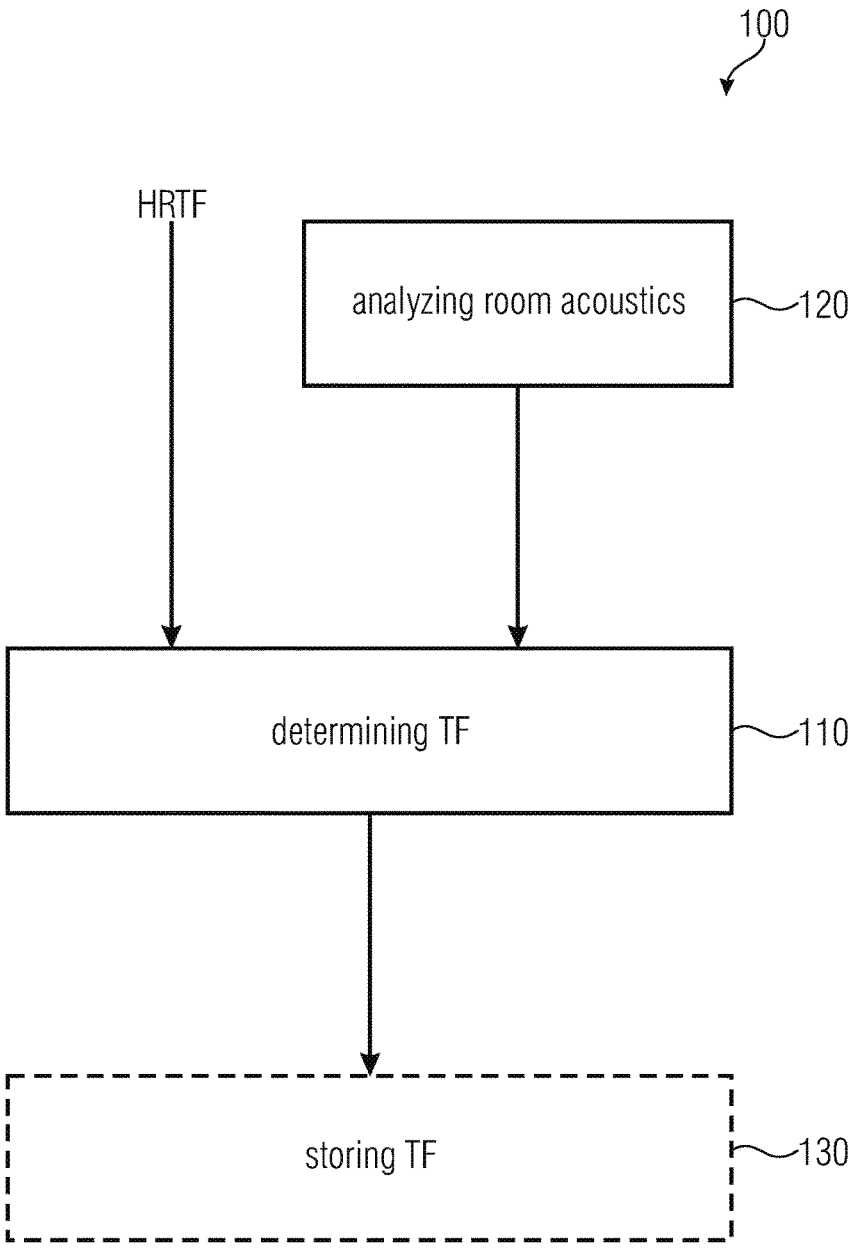
FIG. 1*b* is a schematic flowchart of a method when determining room-optimized transfer functions.

FIG. 1*b* shows a flowchart 100 of the method when determining the room-optimized transfer functions TF. The method 100 includes the central step 110 of determining the room-optimized transfer functions TF. As has already been discussed before, step 110 is based on analyzing the room acoustics 120 (cf. step 120 "analyzing room acoustics") and, optionally, on the HRTF functions present. Starting from step 110, another, optional step may follow. i.e. storing the transfer functions TF. This step is provided with the reference numeral 130.

In correspondence with further embodiments, in the embodiments discussed referring to FIGS. 1*a* and 1*b*, it would also be conceivable to perform determining the position of the listening room in connection with determining the room-optimized transfer functions TF so that the data set obtained in this way may be associated to the listening room directly using the position. This offers the advantage that, in case of fetching the room-optimized transfer functions TF from a database later on, an association of the respective data set starting from determining the position is possible.

Using the room-optimized transfer functions TF determined will be discussed below referring to FIGS. 2*a* and 2*b*.

Figure 2A:
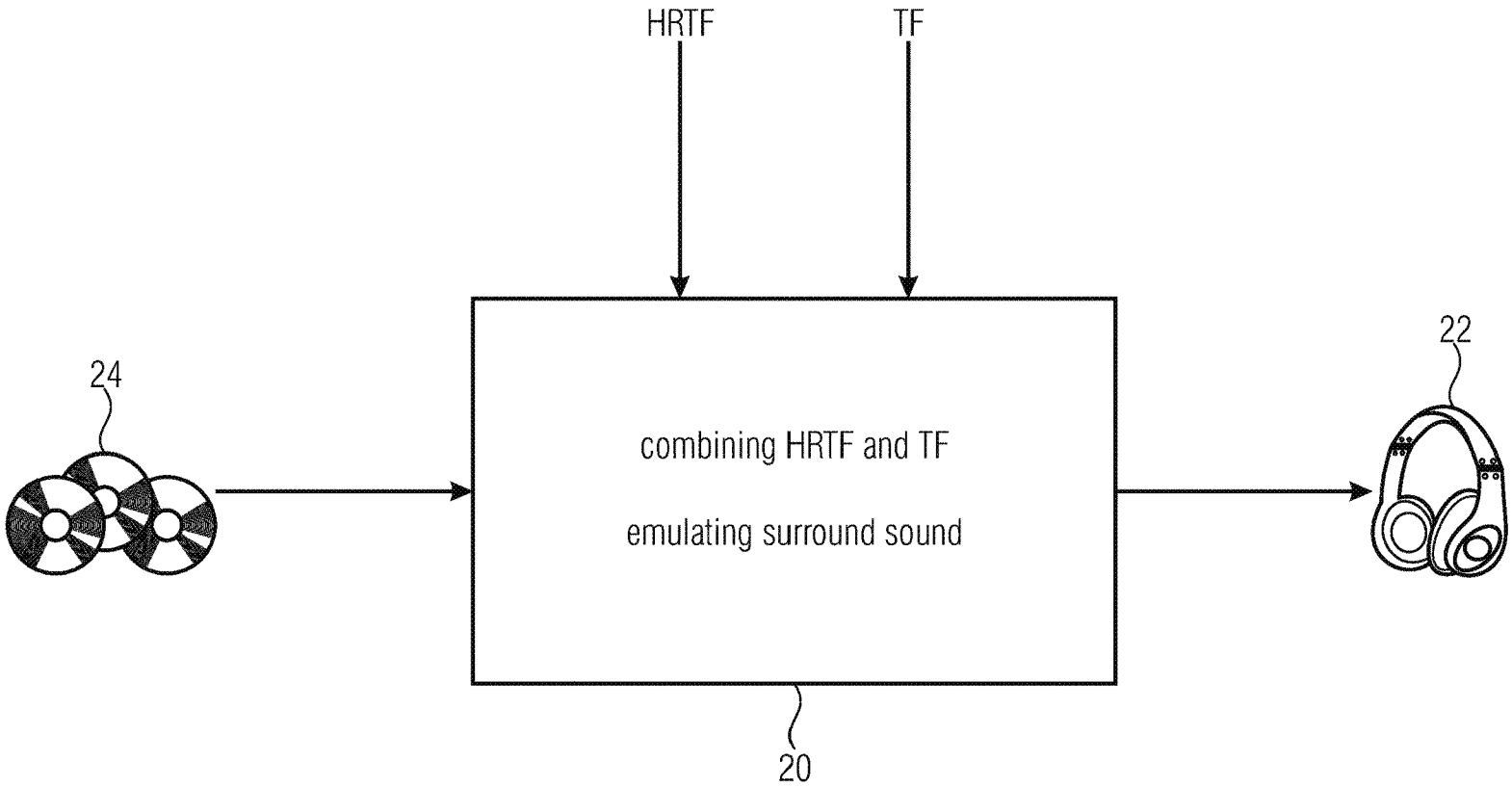
FIG. 2*a* shows a schematic block circuit diagram of a device for spatial reproduction of multi-channel stereo audio material while considering room-optimized transfer functions.
Figure 2B:
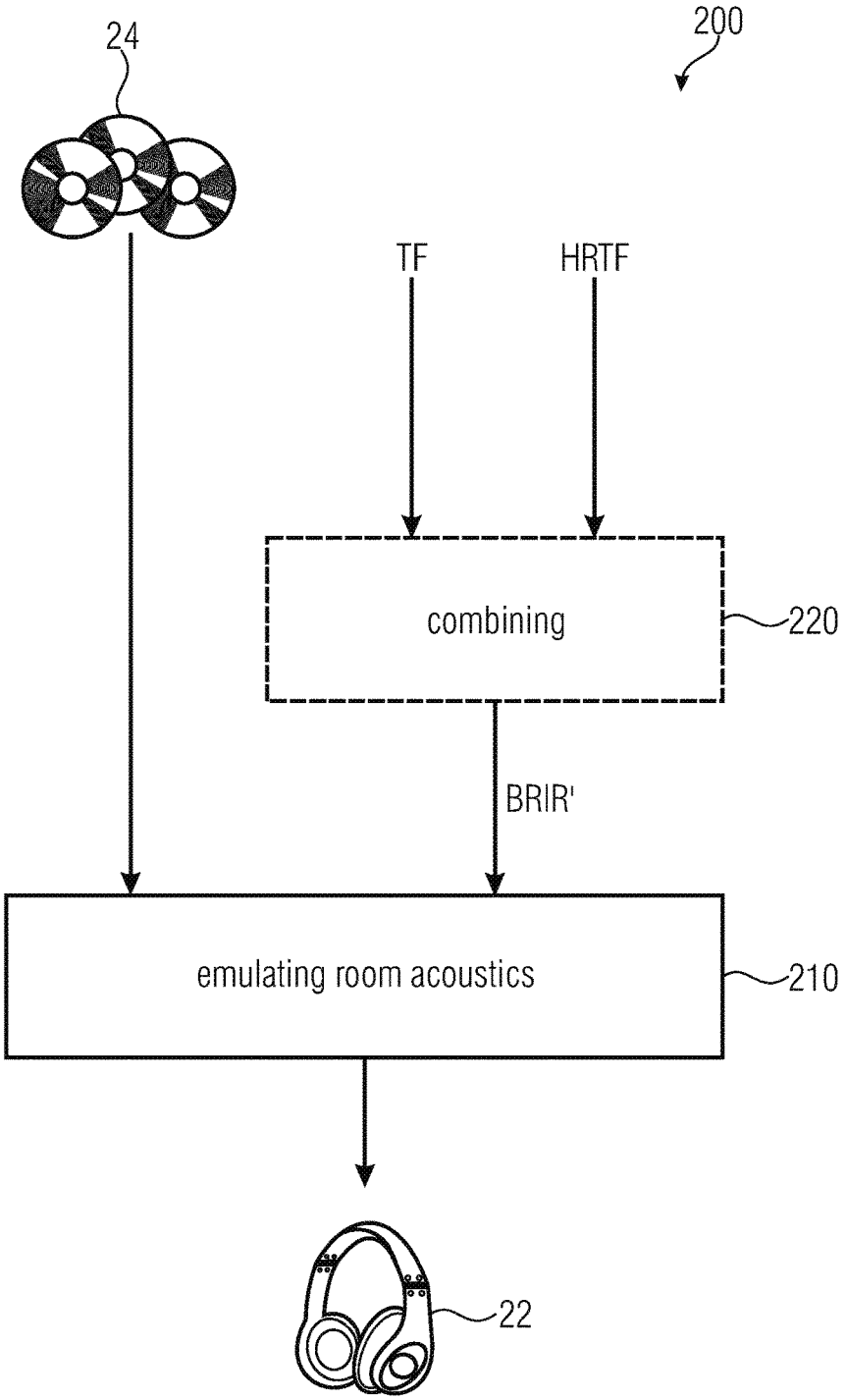
FIG. 2*b* is a schematic flowchart for a method for spatial reproduction of multi-channel stereo audio material while considering room-optimized transfer functions and FIG. 3 shows a schematic block circuit diagram of a system for determining and using room-optimized transfer functions.

FIG. 2*a* shows a device for spatial reproduction 20 using a binaural close-range sound transducer 22. The functionality of the device 20 will be discussed using, among others, the flowchart of FIG. 2*b* illustrating the method 200 of reproduction. The device 20 is configured to reproduce the audio signal 24, such as, for example, a multi-channel stereo audio signal (or an object-based audio signal or an audio signal based on a wave-field synthesis algorithm (WFS)), and to emulate surround sound at the same time (cf. step 210). The reproduction device 20 here processes the audio signal using HRTFs and using the room-optimized transfer functions TF.

The device 20 may include an HRTF/TF storage or is, for example, connected to a database onto which are stored the HRTFs and also the room-optimized transfer functions TF determined in accordance with the above methods. In correspondence with preferred embodiments, before processing the audio signal, combining (cf. step 220) the HRTF and the TF or adapting the HRTF on the basis of the TF takes place. The result of combining is a transfer function BRIR' comparable to the BRIR (room impulse response), using which the audio signal 24 is processed in the end in order to emulate the surround sound (cf. step 210). In principle, this processing corresponds to applying a BRIR'-based filter to the audio signal. Thus, it is also possible to perform binaural synthesis in combination with reverberating the audio signals in dependence on the acoustic conditions prevailing in the listening room, so that, when reproducing, there is a high degree of matching between the synthesized room and the listening room. Consequently, the synthesized room (at least approximately) matches with the horizon of expectations of the user, thereby increasing plausibility of the scene.

In correspondence with embodiments, the device 20 may include also the position-determining unit, such as a GPS-receiver, by means of which the current position of the listener may be ascertained. Departing from the ascertained position, the listening room may be determined and the room-optimized transfer functions TF associated to the listening room be loaded (and, if applicable, updated with a change in room). Optionally, it is also possible to determine the position of the listener in the listening room by means of this position-determining means, in order to illustrate, when stored, the differences in acoustics in dependence on the position of the listener in the room. This position-determining unit may, in correspondence with third embodiments, also be extended by an orientation-determining unit so that the direction of vision of the listener may also be determined and the TFs be loaded correspondingly in dependence on the direction of vision determined in order to come up to the direction-dependent listening room acoustics.

Figure 3:
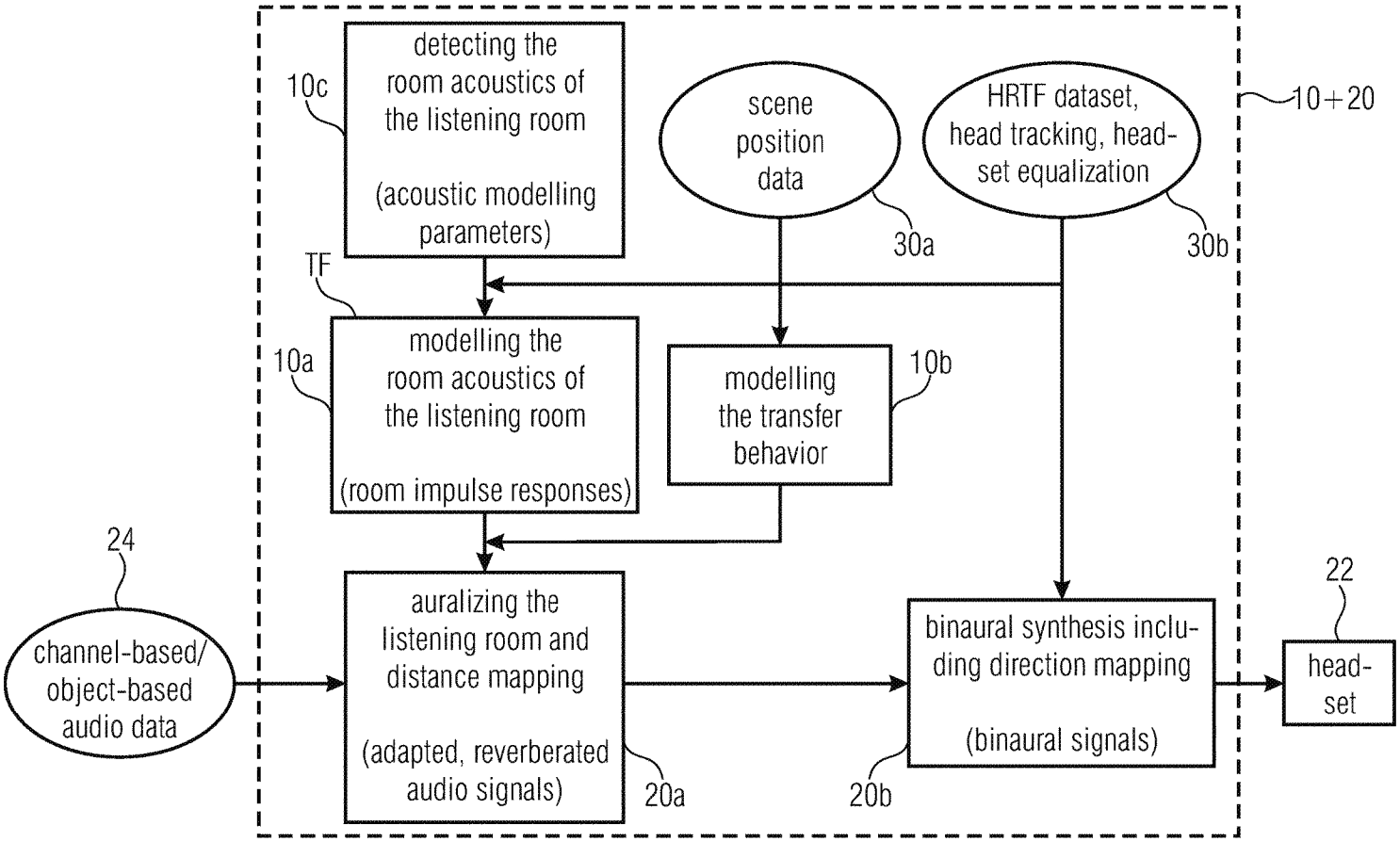

Starting from this basic consideration of the two units 10 and 20, an extended embodiment in FIG. 3 will now be discussed. FIG. 3 shows a schematic illustration of the signal flow when listening to adapted room-acoustic simulations for being used with binaural synthesis starting from a system 10+20 which includes the device for identifying the TFs and the device for reproducing the audio signals using the TFs.

Such a system 10+20 may, for example, be implemented to be a mobile terminal (for example a smartphone) on which the data to be reproduced are stored. The system 10+20 in principle is a combination of the device 10 of FIG. 1*a* and the device 20 of FIG. 1*b*, wherein the individual components are subdivided differently for the sake of a function-oriented discussion.

The system 10+20 includes a functional unit for auralizing the listening room 20*a* and a functional unit for binaural synthesis 20*b*. In addition, the system 10+20 includes a functional block 10*a* for modeling room acoustics and a functional block 10*b* for modeling the transfer behavior. Modeling the room acoustics in turn is based on detecting the listening room which is performed by the functional block 10*c* for detecting the room acoustics. Furthermore, the system 10+20 in the embodiment illustrated includes two storages, i.e. one for storing scene positional data 30*a* and one for storing HRTF data 30*b*. Subsequently, starting from the information flow when reproducing, the functionality of the system 10+20 will be discussed, wherein it is assumed that the listening room is known to the system 10+20 or has been determined already by means of a position-determining method (cf. above).

When reproducing channel-based or object-based audio data 24 using the headset 22, the audio data are fed to the signal processing unit 20*a* in a first step, which applies the room transfer function TF modeled beforehand to the signal 24 and has same to reverberate. Modeling the room transfer function TF takes place in a signal processing block 10*a*, wherein modeling may be superimposed by the modeling transfer behavior (cf. functional block 10*b*), as will be discussed below.

This second (optional) functional block 10*b* models a virtual loudspeaker setup in the respective listening room. Thus, an acoustic behavior may be emulated for the user as if the audio file to be reproduced were reproduced on a certain loudspeaker setup (2.0, 5.1, 9.2). Here, in particular the loudspeaker position is connected fixedly to the listening room and a certain transfer behavior, for example as defined by the frequency response and directional characteristic or varying level behavior, is associated to the respective loudspeakers. It is possible here to fixedly position special sound source types, for example a mirror sound source, in the room. The loudspeaker setup is modeled on the basis of the scene position data which include information on the position, the distance or the type of the virtual loudspeaker. This scene position data may correspond to a real loudspeaker setup, or be based on a virtual loudspeaker setup and may typically be individualized by the user.

After reverberation in the auralization processing unit 20*a*, the reverberated signals are fed to binaural synthesis 20*b* which impresses the direction of the virtual loudspeakers on the audio material belonging to the loudspeaker by means of a set of directional HRTF filters (cf. 30*b*). The binaural synthesis system may, as has been discussed above, optionally evaluate head-turning by the listener. The result is a headset signal which may be adapted to a special headset by a corresponding equalization, the acoustic signal behaving as if output in the respective listening room by a specific loudspeaker setup.

The system 10+20 may, for example, be implemented to be a mobile terminal or components of a home cinema system. Generally, fields of application are reproducing music and entertainment contents, such as, for example, sound for movies or play audio via the binaural close-range sound transducer.

It is to be pointed out here that, in correspondence with an alternative embodiment, the device 20 of FIG. 2*a* may also be configured to emulate a certain loudspeaker setup or reproduction of an audio signal for a certain loudspeaker setup on the basis of scene position data. Correspondingly, in accordance with another embodiment, the device 10 may be configured to determine the scene position data of a loudspeaker setup in the listening room 12 (for example using an acoustic measurement) so that this loudspeaker setup may be emulated by the device 20.

Although some aspects have been described in the context of a device, it is clear that these aspects also represent a description of the corresponding method, such that a block or element of a device also corresponds to a respective method step or a feature of a method step. Analogously, aspects described in the context with or as a method step also represent a description of a corresponding block or item or feature of a corresponding device. Some or all of the method steps may be executed by (or using) a hardware apparatus, like, for example, a microprocessor, a programmable computer or an electronic circuit. In some embodiments, some or several of the most important method steps may be executed by such an apparatus.

An inventively encoded signal, for example an audio signal or a video signal or a transport current signal, may be stored on a digital storage medium or may be transmitted on a transmission medium, for example a wireless transmission medium or a wired transmission medium, for example the Internet.

The inventive encoded audio signal may be stored on a digital storage medium or may be transmitted on a transmission medium, for example a wireless transmission medium or a wired transmission medium, like the Internet.

Depending on certain implementation requirements, embodiments of the invention can be implemented in hardware or in software. The implementation can be performed using a digital storage medium, for example a floppy disk, a DVD, a Blu-Ray disc, a CD, an ROM, a PROM, an EPROM, an EEPROM or a FLASH memory, a hard drive or another magnetic or optical memory having electronically readable control signals stored thereon, which cooperate or are capable of cooperating with a programmable computer system such that the respective method is performed. Therefore, the digital storage medium may be computer readable.

Some embodiments according to the invention include a data carrier comprising electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer.

The program code may for example be stored on a machine-readable carrier.

Other embodiments comprise the computer program for performing one of the methods described herein, wherein the computer program is stored on a machine-readable carrier.

In other words, an embodiment of the inventive method is, therefore, a computer program comprising a program code for performing one of the methods described herein, when the computer program runs on a computer.

A further embodiment of the inventive methods is, therefore, a data carrier (or a digital storage medium or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises processing means, for example a computer, or a programmable logic device, configured to or adapted to perform one of the methods described herein.

A further embodiment comprises a computer having installed thereon the computer program for performing one of the methods described herein.

A further embodiment according to the invention comprises a device or a system configured to transfer a computer program for performing at least one of the methods described herein to a receiver. The transmission can be performed electronically or optically. The receiver may, for example, be a computer, a mobile device, a memory device or the like. The apparatus or system may, for example, comprise a file server for transferring the computer program to the receiver.

In some embodiments, a programmable logic device (for example a field programmable gate array, FPGA) may be used to perform some or all of the functionalities of the methods described herein. In some embodiments, a field programmable gate array may cooperate with a microprocessor in order to perform one of the methods described herein. Generally, in some embodiments, the methods are preferably performed by any hardware device. This can be a universally applicable hardware, such as a computer processor (CPU), or hardware specific for the method, such as ASIC.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A device for determining room-optimized transfer functions for a listening room derived for the listening room and serving for room-optimized post-processing of audio signals in spatial reproduction, wherein the spatial reproduction of the audio signals is emulated by means of a binaural close-range sound transducer using known head-related transfer functions and using the room-optimized transfer functions, wherein a room to be synthesized may be emulated based on the head-related transfer functions, and wherein the listening room may be emulated based on the room-optimized transfer functions, wherein the device is configured to analyze room acoustics of the listening room and to determine, starting from analyzing the room acoustics, the room-optimized transfer functions for the listening room where the spatial reproduction by means of the binaural close-range sound transducer is to take place, wherein the device comprises a storage in which may be deposited a plurality of room-optimized transfer function families for a plurality of listening rooms, wherein emulating the spatial reproduction is based on interaural features, balance features and distance features, wherein the interaural features comprise a connection between a direction of incidence in the medial planes and an individual or non-individual head-related filtering, wherein the balance features comprise a connection between a lateral direction of incidence and a difference in volume and/or a connection between the lateral direction of incidence and a run-time difference, wherein the distance features comprise a connection between a virtual distance and frequency-dependent filtering and/or a connection between the virtual distance and an initial time gap and/or a connection between the virtual distance and a reflection behavior.

2. The device in accordance with claim 1, wherein the room-optimized transfer functions comprise, per room, a plurality of transfer functions associated to individual solid angles.

3. The device in accordance with claim 1, wherein the device comprises a microphone of a portable device for acoustic measurement and/or wherein analysis of the room acoustics of the listening room takes place by means of an acoustic measurement in the listening room using ambient noise and/or using a test signal.

4. The device in accordance with claim 3, wherein the room-optimized transfer functions are selected such that room acoustics of the listening room may be emulated on the basis thereof.

5. The device in accordance with claim 1, wherein the analysis of the room acoustics of the listening room is based on calculating a geometrical model of the listening room and/or modeling the geometrical model based on a camera-based model of the listening room.

6. The device in accordance with claim 1, wherein the device is configured to determine the room-optimized transfer functions considering a virtual loudspeaker setup in correspondence with which a number of virtual loudspeakers are positioned in the listening room.

7. The device in accordance with claim 1, wherein the known head-related transfer functions comprise a plurality of individual transfer functions for the left and right ears which are associated to directional vectors for a plurality of virtual sound sources.

8. The device in accordance with claim 1, wherein the room-optimized transfer functions comprise a plurality of individual, directional transfer functions.

9. The device in accordance with claim 1, wherein the binaural close-range sound transducer is a headset configured to output as the audio signal a multi-channel stereo signal, an object-based audio signal and/or an audio signal on the basis of a wave-field synthesis algorithm.

10. A method for determining room-optimized transfer functions for a listening room which are derived for the listening room and may serve for room-optimized post-processing of audio signals in spatial reproduction, wherein the spatial reproduction of the audio signals by means of a binaural close-range sound transducer is emulated using known head-related transfer functions and using the room-optimized transfer functions, wherein a room to be synthesized may be emulated based on the head-related transfer functions, and wherein the listening room may be emulated based on the room-optimized transfer functions, comprising:

analyzing prevailing room acoustics of the listening room; and determining the room-optimized transfer functions for the listening room where spatial reproduction by means of the binaural close-range sound transducer is to take place, on the basis of analyzing the room acoustics;

depositing a plurality of room-optimized transfer function families for a plurality of listening rooms, wherein emulating the spatial reproduction is based on interaural features, balance features and distance features, wherein the interaural features comprise a connection between a direction of incidence in the medial planes and an individual or non-individual head-related filtering, wherein the balance features comprise a connection between a lateral direction of incidence and a difference in volume and/or a connection between the lateral direction of incidence and a run-time difference, wherein the distance features comprise a connection between a virtual distance and frequency-dependent filtering and/or a connection between the virtual distance and an initial time gap and/or a connection between the virtual distance and a reflection behavior.

11. The method in accordance with claim 10, wherein the room-optimized transfer functions comprise, per room, a plurality of transfer functions associated to individual solid angles.

12. A device for spatial reproduction of an audio signal by means of a binaural close-range sound transducer, wherein the spatial reproduction is emulated using known head-related transfer functions and using room-optimized transfer functions for a listening room, wherein a room to be synthesized may be emulated based on the head-related transfer functions, and wherein the listening room may be emulated based on the room-optimized transfer functions, wherein the room-optimized transfer functions have been determined beforehand for the respective listening room;

wherein the device comprises a first storage in which are stored a first plurality of transfer function families for different listening rooms, and a position-determining unit, wherein the position-determining unit is configured to identify the position and determine the listening room using the position identified; and wherein the device is configured to select, for emulating the spatial reproduction, the corresponding transfer functions for the respective listening room from the transfer function families, wherein emulating the spatial reproduction is based on interaural features, balance features and distance features, wherein the interaural features comprise a connection between a direction of incidence in the medial planes and an individual or non-individual head-related filtering, wherein the balance features comprise a connection between a lateral direction of incidence and a difference in volume and/or a connection between the lateral direction of incidence and a run-time difference, wherein the distance features comprise a connection between a virtual distance and frequency-dependent filtering and/or a connection between the virtual distance and an initial time gap and/or a connection between the virtual distance and a reflection behavior.

13. The device in accordance with claim 12, wherein the room-optimized transfer functions comprise, per room, a plurality of transfer functions associated to individual solid angles.

14. The device in accordance with claim 12, wherein the device comprises a second storage in which are stored a second plurality of transfer function families for different orientations, and an orientation-determining unit, wherein the orientation-determining unit is configured to determine an orientation in the listening room, and wherein the device is configured to select, for emulating the spatial reproduction, the corresponding transfer functions for the respective orientation from the transfer function families.

15. The device in accordance with claim 12, wherein the device comprises a third storage in which are stored a third plurality of transfer function families for different positions in the listening room, and another position-determining unit, wherein the other position-determining unit is configured to determine a position in the listening room, and wherein the device is configured to select, for emulating the spatial reproduction, the corresponding transfer functions for the respective position in the listening room from the transfer function families.

16. The device in accordance with claim 12, wherein the position-determining unit is configured to determine, while reproducing, the positions again, and wherein the device is configured to update the room-optimized transfer functions based on the updated position.

17. A method for spatially reproducing an audio signal by means of a binaural close-range sound transducer, comprising:

post-processing the audio signal using known head-related transfer functions and using room-optimized transfer functions for a listening room which have been determined beforehand for the listening room where reproduction by means of the binaural close-range sound transducer is to take place, wherein a room to be synthesized may be emulated based on the head-related transfer functions, and wherein the listening room may be emulated based on the room-optimized transfer functions;

storing a first plurality of transfer function families for different listening rooms in a first storage;

identifying a position; and determining the listening room using the position, wherein the device is configured to select, for emulating the spatial reproduction, the corresponding transfer functions for the respective listening room from the transfer function families, wherein emulating the spatial reproduction is based on interaural features, balance features and distance features, wherein the interaural features comprise a connection between a direction of incidence in the medial planes and an individual or non-individual head-related filtering, wherein the balance features comprise a connection between a lateral direction of incidence and a difference in volume and/or a connection between the lateral direction of incidence and a run-time difference, wherein the distance features comprise a connection between a virtual distance and frequency-dependent filtering and/or a connection between the virtual distance and an initial time gap and/or a connection between the virtual distance and a reflection behavior.

18. The method in accordance with claim 17, wherein the room-optimized transfer functions comprise, per room, a plurality of transfer functions associated to individual solid angles.

19. The method in accordance with claim 17, wherein, before reproducing, combining the head-related transfer functions and the room-optimized transfer functions to form a room-related room impulse response takes place.

20. A system comprising:

a device for determining room-optimized transfer functions for a listening room derived for the listening room and serving for room-optimized post-processing of audio signals in spatial reproduction, wherein the spatial reproduction of the audio signals is emulated by means of a binaural close-range sound transducer using known head-related transfer functions and using the room-optimized transfer functions, wherein a room to be synthesized may be emulated based on the head-related transfer functions, and wherein the listening room may be emulated based on the room-optimized transfer functions, wherein the device is configured to analyze room acoustics of the listening room and to determine, starting from analyzing the room acoustics, the room-optimized transfer functions for the listening room where the spatial reproduction by means of the binaural close-range sound transducer is to take place, wherein the device comprises a storage in which may be deposited a plurality of room-optimized transfer function families for a plurality of listening rooms; and a device in accordance with claim 12.

21. A non-transitory digital storage medium having stored thereon a computer program for performing a method for determining room-optimized transfer functions for a listening room which are derived for the listening room and may serve for room-optimized post-processing of audio signals in spatial reproduction, wherein the spatial reproduction of the audio signals by means of a binaural close-range sound transducer is emulated using known head-related transfer functions and using the room-optimized transfer functions, wherein a room to be synthesized may be emulated based on the head-related transfer functions, and wherein the listening room may be emulated based on the room-optimized transfer functions, comprising:

analyzing prevailing room acoustics of the listening room; and determining the room-optimized transfer functions for the listening room where spatial reproduction by means of the binaural close-range sound transducer is to take place, on the basis of analyzing the room acoustics;

depositing a plurality of room-optimized transfer function families for a plurality of listening rooms, when said computer program is run by a computer, wherein emulating the spatial reproduction is based on interaural features, balance features and distance features, wherein the interaural features comprise a connection between a direction of incidence in the medial planes and an individual or non-individual head-related filtering, wherein the balance features comprise a connection between a lateral direction of incidence and a difference in volume and/or a connection between the lateral direction of incidence and a run-time difference, wherein the distance features comprise a connection between a virtual distance and frequency-dependent filtering and/or a connection between the virtual distance and an initial time gap and/or a connection between the virtual distance and a reflection behavior.

22. A non-transitory digital storage medium having stored thereon a computer program for performing a method for spatially reproducing an audio signal by means of a binaural close-range sound transducer, comprising:

post-processing the audio signal using known head-related transfer functions and using room-optimized transfer functions for a listening room which have been determined beforehand for the listening room where reproduction by means of the binaural close-range sound transducer is to take place, wherein a room to be synthesized may be emulated based on the head-related transfer functions, and wherein the listening room may be emulated based on the room-optimized transfer functions;

storing a first plurality of transfer function families for different listening rooms in a first storage;

identifying a position; and determining the listening room using the position, wherein the device is configured to select, for emulating the spatial reproduction, the corresponding transfer functions for the respective listening room from the transfer function families, when said computer program is run by a computer, wherein emulating the spatial reproduction is based on interaural features, balance features and distance features, wherein the interaural features comprise a connection between a direction of incidence in the medial planes and an individual or non-individual head-related filtering, wherein the balance features comprise a connection between a lateral direction of incidence and a difference in volume and/or a connection between the lateral direction of incidence and a run-time difference, wherein the distance features comprise a connection between a virtual distance and frequency-dependent filtering and/or a connection between the virtual distance and an initial time gap and/or a connection between the virtual distance and a reflection behavior.

* * * * *